United States Patent [19]

Neukomm

[11] 4,201,234

[45] May 6, 1980

[54] FILTER FOR SMOKING ARTICLE, MAINLY CIGARETTE

[75] Inventor: Serge Neukomm, Antagnes sur Ollon, Switzerland

[73] Assignee: Sasmoco, S.A., Lenzerheide, Switzerland

[21] Appl. No.: 879,625

[22] Filed: Feb. 21, 1978

[30] Foreign Application Priority Data

Feb. 21, 1977 [CH] Switzerland ..... 2116/77

[51] Int. Cl.[2] ..... A24B 15/02; B01D 25/02; B01D 26/06; B01D 27/02

[52] U.S. Cl. ..... 131/265; 131/10.7; 131/10.9; 131/266

[58] Field of Search ..... 131/10 R, 10.7, 10.9, 131/11, 261 R, 261 B, 262 R, 264, 265, 269, 266, 10.3, 15 R, 9, 17 R, 140 C, 17 A, 10.5, 140 B; 93/1 C, 77 FT

[56] References Cited

U.S. PATENT DOCUMENTS

| | | | |
|---|---|---|---|
| 3,251,365 | 5/1966 | Keith et al. | 131/10.7 |
| 3,354,886 | 11/1967 | Berger et al. | 131/269 |
| 3,608,563 | 9/1971 | Schmitz | 131/10.7 |
| 3,718,612 | 2/1973 | Strickman | 131/265 |
| 3,977,417 | 8/1976 | Hoelzel et al. | 131/269 |

*Primary Examiner*—V. Millin

*Attorney, Agent, or Firm*—Ostrolenk, Faber, Gerb & Soffen

[57] ABSTRACT

The invention is related to a new and improved filter for smoking articles, especially cigarettes, of the cavity type. In order to achieve better filtration, the cavity which is delimited by two substantially cylindrical filter portions made of fibrous material, spaced apart in the longitudinal direction of said filter, contains a particulate filtering matter being composed of two physical fractions of particles, the mean diameter of the particles of the first fraction being 20 to 50 times the mean diameter of the particles of the second fraction. Preferably, the particles of the first fraction have a mean diameter comprised between 0.2 and 1.2 mm, more preferably between 0.6 and 1.0 mm, and the particles of the second fraction have a mean diameter comprised between 0.006 and 0.040, more preferably between 0.010 and 0.030 mm. It is preferred that the volume ratio of the first to the second fraction is at least 2:1 and may amount until 50:1.

11 Claims, 1 Drawing Figure

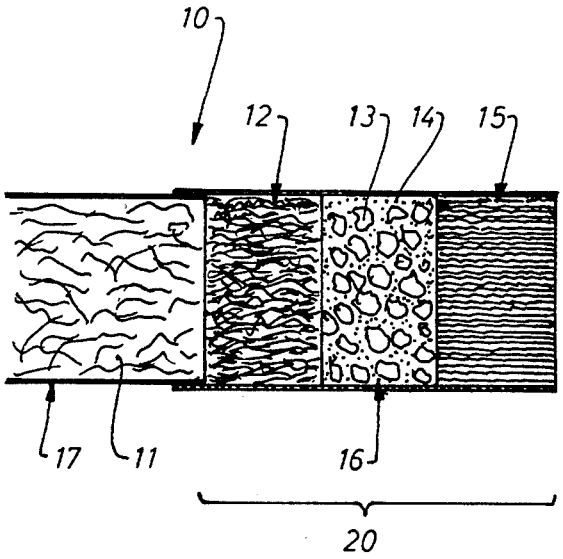
10
12
13
14
15
17
11
16
20

FILTER FOR SMOKING ARTICLE, MAINLY CIGARETTE

The present invention refers to filters. It specially deals with a new and elaborate filter for smoking articles having a highly improved filtering capacity.

Tobacco smoke is essentially composed of two phases: a gaseous phase and a particulate matter phase. Each phase is in itself composed of a great number of noxious compounds. As a result, numerous filtration systems have been developed for reducing altogether the one or the other, or the one and the other of these phases. Some systems are capable of reducing more or less specifically certain well-defined noxious compounds, as was already described in Swiss patent application No. 012901/75, filed Sept. 29, 1975, in the name of Serge Neukomm, or reference to which is also contained as an example in German (GFR) patent No. 1 767 024 to F. J. Burrus & Cie. Above application and the patent are incorporated for reference in present specification.

It is the object of present invention to provide a filter for tobacco products, mainly cigarettes, being of the cavity filter type, known by itself, comprising a cavity limited by two roughly cylindrical segments made of fibrous material, spaced apart in the longitudinal filter direction, and the cavity including a particulate filtration material, with the new filter being capable of noticeably increasing the retention of noxious compounds of the tobacco smoke.

A further object of the invention is to provide a filter of the type described hereinabove, being very simple and advantageous from an economical viewpoint.

Still another object of the invention is to provide a filter of the type described, capable of securing the best filtration capacity without special treatment of the particulate filtration material.

These objects are achieved, according to the invention, by a filter wherein the particulate filtration material comprises two physical portions of granules, the average diameter of the granules of the first portion being 20 to 50 times higher with respect to the average diameter of the second portion.

Applicant accordingly found out that the efficiency of a cavity filter can be increased significantly regarding the particulate phase in arranging within the cavity a mixture of at least two types of granules in variable proportions:

(a) a portion of granlues of large average diameter
(b) a portion of granules of small average diameter.

By "average diameter" of the granules of each one of the two portions is meant the most frequently occurring maximum cross dimension of the particles in a sample lot of the specified portion, selected at random, the diameters being established by direct measurement with a microscope. In general, the distribution of the particles according to their diameter corresponds at least approximately to the well known statistical distribution of Gauss.

The shape of the granules in both portions is not crucial. Granules of irregular shape and showing roughness do however have preference. The expert knows that such granules in general do have a better filtering ability, namely an adsorptive and/or absorptive one.

The chemical substance of the granules is not crucial either; all granules made of known substance can be used for the purpose. Examples, in no way restrictive, are as follows: activated carbon, silica gel, silica dioxide, alumina, kaolin, bentonite, silicate of magnesium, etc. Organic, natural or synthetic substances are suitable as well, as for example granules made of cellulose, cellulose acetate, carboxymethyl cellulose, methyl and benzyl cellulose, agar-agar, hemoglobin powder, starch, corn and maize flour, and synthetic polymers like polyvinylpyrrolidone, nylon, polystyrene, etc.

"Physical portion" means a portion of granules exclusively rated by arrangement as to size, in disregarding any chemical property, as explained hereinbelow.

The two filter segments which border the cavity comprising the granules are elements known to the expert. These segments comprise treated or non-treated fibers, generally oriented in the longitudinal direction of the filter and consisting of cellulose, of cellulose derivates like cellulose acetate, or of other natural or synthetic polymer fibrous material. The length of these two filtering segments ranges between 3 and 10 millimeters and is generally of approx. 5 millimeters. The same dimensions apply to the cavity. The diameter of the two filter segments as well as of the cavity correspond to the one of the smoking article, that is for a cigarette between 7 and 10 millimeters, generally approx. 8 millimeters. It is appropriate to mention that the filtering segments are available on the market.

The accompanying drawing is a sectional view of a filter illustrating an embodiment of the invention. There is shown a cigarette 10 made of tobacco 11 and wrapping paper 17. The filter 20 comprises a first fibrous filtering segment 12, a cavity 16 and a second fibrous filtering segment 15. Cavity 16 is filled with particles 13 of large average diameter and with particles 14 of small average diameter.

The portion of granules of large average diameter, that is the first portion, comprises particulate substances the average diameter of which may vary from 0.2 to 1.2 mm, preferably from 0.6 to 1.0 mm, whereas the portion of granules of small average diameter comprises particulate substances the average diameter of which may vary from 0.006 to 0.040 mm, preferably from 0.010 to 0.030 mm, that is in a preferential diameter ratio of 50/1 to 20/1 (large diameter/small diameter).

The two granular portions may be composed of particles having the same chemical combination and nature or being different, that is each portion might be a mixture of particles of different nature, preferably different in view of achieving certain specific filtration effects on one or the other of the gaseous or particulate matter phases of the tobacco smoke. The portion of granules of large average diameter may also be composed of a mixture of granules having a different chemical nature and likewise for the portion of granules of small average diameter.

Quantitatively, and according to the invention, the mixture of two portions of granules, a large average diameter one and a small average diameter one, may be composed of variable proportions of each of the two classes of granules, but should preferably be in the proportion of 2 volumes of particles of large average diameter for 1 volume of particles of small average diameter.

This volumetric ratio is important. It is a measurement of the circulation capacity of the particles of the second portion, showing the small average diameter, within the empty spaces existing between the particles of the first portion. Without binding himself to a theory, Applicant feels that the increased filtration capacity of the filter according to the present invention is at least partly due to the more or less freely practicable circulation, under the influence of the smoke stream, of the particles of small average diameter within said empty spaces, and thereby offering still new active surfaces to the smoke. The filter according to the present invention is thus a dynamic rather than a static filter.

Said volumetric ratio shall be selected in such a manner that the empty spaces between the particles of large average diameter be not completely clogged. This volumetric ratio between large particles and small particles is at least of 2:1 and may reach the proportion of 10:1. In general it shall be selected between 4:1 and 5:1. In a preferred embodiment of the filter according to the invention, it is approximately 2:1.

In addition said ratio shall be selected as a result of the average diameters of the two portions of granules. The volumetric ratio of both portions may get close to the critical value of 2:1 and even reach it when the ratio of the two different average diameters approaches the limit value of 50:1.

The two types of particles described may represent the only filter material of the cavity and the small particles can circulate therein in a certain way as explained hereinabove. The particles can however as well be fixed in the cavity by means of a matrix in order to avoid the particles of small average diameter of being pulled along by the smoke towards the internal surface of the filter mouthpiece where they might obturate the pores of this filter tip. The matrix can be made of cotton, of a foam sponge, of filaments or of a film etc. The matrix may even be composed of agglomerate particles of large average diameter.

The selection of the nature and structure of the filter segments made of fibers is basically immaterial with respect to the filter segment bordering on the tobacco. However the external filter segment (filter tip) must be formed in such a way that its filament structure and its pores be in a position to hold back over a distance not exceeding 5 mm, preferably 3 mm, the smallest particles of the class of particles of small average diameter. This restriction can presently be met easily, for instance through simple cellulose acetate filters which are currently manufactured and sold.

The following non-limitative examples shall merely serve the purpose of illustrating embodiments of the invention and of the results thereby attained.

EXAMPLE 1

Cavity filter, made of a segment of current cellulose fibers (sold under the name DICO, tradename of Baumgartner S. A., Lausanne, Switzerland) of 5 mm length—on the tobacco end of it—and of a segment of cellulose acetate fibers of 5 mm length, 8 mm in diameter, spaced by a cavity 5 mm long containing either activated carbon only the granules of which show an average diameter of 1 mm (limit values 0.6 and 1.8 mm), or a mixture of activated carbon having the same physical properties as the previous one (2 volumes) and of a hemoglobin powder as is used in the preparation of micro-biological cultures and available on the market (1 volume) the particles of which show an average diameter of 0.020 mm (limit values 0.002 and 0.050 mm), mechanically attached to cigarettes composed of two different blends of "Maryland" tobacco: average length of the cigarettes 78 mm; average length of the filter section 15 mm; average length of tobacco section 63 mm; length of the butt 23 mm; length of burned tobacco 55 mm. Processing, sampling and smoke tests are performed in accordance with the CORESTA specifications (European Committee for research and standardization on tobacco smoke, Paris, France) by an automatic "open" type machine with electrostatic trapping. The comparative results of the dry tar and nicotine analysis are shown in following chart. In this chart A designates the first Maryland tobacco blend and B designates the second blend.

| Maryland Tobacco | Average weight cig. (g) | Dry tar (mg) | Nicotine (mg) |
|---|---|---|---|
| A (1) with carbon filter only (control) | 1.065 | 15.51 | 1.09 |
| A (2) with carbon + powder filter (volume 2/1) (invention) | 1.070 | 5.34 | 0.30 |
| B (1) with carbon filter only (control) | 0.986 | 14.57 | 1.11 |
| B (2) with carbon + powder filter (volume 2/1) (invention) | 1.038 | 1.36 | 0.06 |

EXAMPLE 2

Cavity filters showing the same physical-chemical properties as in Example 1, but attached to cigarettes composed of two different blends of "American Blend" tobacco and having the same dimensions as for the previous ones, smoked and tested according to same standards as the ones in Example 1 and providing the following results:

| Maryland Tobacco | Average weight cig. (g) | Dry tar (mg) | Nicotine (mg) |
|---|---|---|---|
| A (1) with carbon filter only (control) | 1.154 | 19.50 | 1.23 |
| A (2) with carbon + powder filter (volume 2/1) (invention) | 1.152 | 5.11 | 0.18 |
| B (1) with carbon filter only (control) | 1.045 | 15.17 | 1.02 |
| B (2) with carbon + powder filter (volume 2/1) (invention) | 1.091 | 3.88 | 0.14 |

The filter according to the invention applies to all smoking articles, for instance cigar, cigarillo, pipe, etc. However, its use in connection with cigarettes has preference.

EXAMPLE 3

A cavity filter as described in Example 1 but having a cellulose section of 6 mm length instead of 5 mm, a cavity length of 6 mm and a cellulose acetate section of 8 mm length, was filled with (a) a mixture of hemoglobin powder, average particule diameter 0.020 mm, one volume, and activated carbon, average particule diameter 0.625 mm, three volumes, and, for another test, with (b) agar agar powder, average diameter 0.027 mm, and the above defined activated carbon, in a volume ratio of 1:3, and, for comparative purposes, (c) with a 1:1 volume ratio of magnesium silicate particles and the above defined activated carbon. The filter (c) is a known and currently used one.

Each of these filters was attached to a Maryland tobacco cigarette, mean weight 1.07 g, forming a filter cigarette of a total length of 78 mm. These cigarettes were smoked under strongly standardized conditions, and the tar condensate of 400 smoked cigarettes was collected. The following results have been obtained:

| | condensate, mg per cig. |
|---|---|
| (a) cigarettes with carbon and hemoglobin powder filter (invention) | 3.3 |
| (b) cigarettes with carbon and agar agar powder filter (invention) | 5.8 |
| (c) cigarettes with magnesium silicate and carbon filter (comparative) | 11.7 |

EXAMPLE 4

From cigarettes "Players No. 6", Swiss made, the original filter was removed. 400 of these filterless cigarettes were smoked on a smoking machine. A second lot of 400 cigarettes was provided with the best filter presently on the market, i.e. the filter "Select X 4". A third lot of 400 cigarettes was provided with a filter according to the invention, that of Example 3, containing in its cavity particules of activated carbon, mean diameter 0.5 mm, and agar agar powder, mean diameter 0.025 with the limits of 0.020 and 0.030 mm, the volume ratio carbon: agar agar being 5:1.

All cigarettes were smoked under identical and strictly standardized conditions. The tar condensate after smoking was the following:

| | condensate, mg per cigarette |
|---|---|
| (1) cigarettes without filter (comparative) | 22.9 |
| (2) cigarettes with filter "Select X 4" | 15.7 |
| (3) cigarettes with filter of invention | 11.7 |

All Examples clearly show the greatly improved and surprisingly high filtering effect of the new filter according to the invention.

What is claimed is:

1. A tobacco smoke filter comprising: two substantially cylindrically shaped filtering segments each comprised of fibrous material and being spaced apart in the longitudinal direction of the filter to define a cavity therebetween, said cavity containing a particulate filtering material, said particulate filtering material being composed of a mixture of two different groups of non adhered granules, the average diameter of said granules of the first said group being 20 to 50 times greater than the average diameter of said granules of the second said group.

2. Filter according to claim 1, wherein said granules of said first group have an average diameter of between 0.2 and 1.2 mm and said granules of said second group have an average diameter of between 0.006 and 0.040 mm.

3. Filter according to claim 1, wherein said granules of said first group have an average diameter of between 0.6 and 1.0 mm and said granules of said second group have an average diameter of between 0.010 and 0.030 mm.

4. Filter according to any of claims 1, 2 or 3, wherein the volumetric ratio of said first group in relation to said second group is at least equal to 2:1.

5. Filter according to claim 1, wherein the chemical composition of said granules of said first group is substantially similar to the chemical composition of said granules of said second group.

6. Filter according to claim 1, wherein the chemical composition of said granules of first group is different from the chemical composition of said granules of said second group.

7. Filter according to claim 1, wherein said first group of granules comprises a mixture of particles having various chemical natures selected from the group consisting of inorganic, organic, synthetic and natural particles.

8. Filter according to claim 1, wherein said second group of granules comprises a mixture of particles having various chemical natures selected from the group consisting of inorganic, organic, synthetic and natural particles.

9. Filter according to any of claims 1, 2 or 3, wherein one of said segments is formed for holding back, over a distance of 3 to 5 mm into said segment from said cavity, the smallest said granules of said second group.

10. Filter according to any of claims 1, 2 or 3, further comprising a porous matrix included in said cavity for holding said granules of said second group in place.

11. Filter according to any of claims 1, 2 or 3, wherein the volumetric ratio of said first group in relation to said second group is in the range of 2:1 to 10:1.

* * * * *